United States Patent [19]

Manning

[11] Patent Number: 4,560,074

[45] Date of Patent: Dec. 24, 1985

[54] SCAFFOLD MOUNTED HOIST

[76] Inventor: Charles E. Manning, 1407 Hickory St., Crossett, Ark. 71635

[21] Appl. No.: 624,134

[22] Filed: Jun. 25, 1984

Related U.S. Application Data

[63] Continuation of Ser. No. 452,795, Dec. 23, 1982, abandoned.

[51] Int. Cl.[4] ..... B66C 13/18; B66C 23/02

[52] U.S. Cl. ..... 212/152; 212/223; 212/249; 212/252

[58] Field of Search ..... 212/149, 152, 159, 175, 212/179–180, 199, 202, 204, 214, 223, 224, 229, 245, 249, 252, 254

[56] References Cited

U.S. PATENT DOCUMENTS

| | | | |
|---|---|---|---|
| 754,586 | 3/1904 | Maxwell | 212/252 |
| 872,050 | 11/1907 | Burhans | 212/223 |
| 1,509,800 | 9/1924 | Vogel | 212/252 |
| 1,569,686 | 1/1926 | Tirrell | 212/223 |
| 2,379,599 | 7/1945 | Smith | 212/152 |
| 2,670,086 | 2/1954 | Eisberg | 212/252 |
| 2,686,600 | 8/1954 | Smith | 212/223 |
| 2,744,637 | 5/1956 | Stewart | 212/152 |
| 2,917,189 | 12/1959 | Isaacs | 212/249 |
| 3,391,906 | 7/1968 | Duerst | 212/152 |
| 4,300,134 | 11/1981 | Paciorek | 212/152 |

FOREIGN PATENT DOCUMENTS

| | | | |
|---|---|---|---|
| 233412 | 6/1959 | Australia | 212/223 |
| 16829 | 4/1913 | France | 212/223 |
| 472322 | of 0000 | France | 212/223 |
| 1159270 | 6/1958 | France | 212/223 |
| 2453102 | 12/1980 | France | 212/149 |
| 13243 | 2/1977 | Japan | 212/179 |
| 109002 | 8/1917 | United Kingdom | 212/223 |
| 644104 | 10/1950 | United Kingdom | 212/252 |
| 2087346 | 5/1982 | United Kingdom | 212/159 |

*Primary Examiner*—Trygve M. Blix
*Assistant Examiner*—R. B. Johnson
*Attorney, Agent, or Firm*—Robert R. Keegan

[57] ABSTRACT

There is disclosed a hoist adapted to be mounted on a conventional sectional scaffold structure in which the hoist apparatus consists of a boom assembly to be mounted near the top of a scaffold structure and a winch assembly to be mounted near the bottom of such structure. The winch assembly includes a cable drum and a cable, a worm gear drive for the drum and a two-speed pulley drive from the motor to the worm gear. The cable runs upwardly in proximity to a column of the scaffold structure and through a short hollow vertical mast section on top of which is mounted a rotatable boom having a pair of pulleys to guide the cable out of the top of the mast section to the end of the boom and downwardly to receive a load. The mast section supporting the boom may be only about six feet long and is removably attached to a column of the scaffold structure so that the scaffold structure effectively supplies the mast for the boom of the hoist. A remote control is provided for the motor to reverse or de-energize it for controllably raising a load and an automatic stop on the boom de-energizes the motor to stop the load at its end of travel.

7 Claims, 12 Drawing Figures

83
15
13
10
61
193
173
191
174
15

15
174
176
175
178
177
183
173
191
193
181
184
179
187
195
185
189

10
15
171
172
66
172
11

SCAFFOLD MOUNTED HOIST

This application is a continuation of application Ser. No. 452,795, filed Dec. 23, 1982, now abandoned.

The present invention relates to hoist apparatus for use in construction of multi-story apartment buildings, commercial buildings and other structures. The exterior work on such structures frequently involves the erection of a sectional scaffold. As work progresses the height of the scaffold is increased by adding additional sections on the top. Such scaffolding is commonly mad of tubular steel sections arranged so that the section's ends fit one within the other and are retained in place by pins or the like. The use of such sectional reusable steel scaffolding is almost universal, and it is very rare that a wooden scaffold or other than a sectional reusable scaffold structure is employed in modern construction.

The need for a hoist to deliver materials such as brick, mortar, or other construction materials to the top working platform of the scaffold is frequently met by a large crane capable of lifting quite heavy loads to the height of as much as 100 feet to which the scaffolds may be erected. The rental or other cost of such a crane and the hiring of a full-time operator for it is a very substantial expense which the present scaffold mountable hoist apparatus frequently makes unnecessary.

In other situations an elevator may be employed together with a scaffold to deliver materials but this also has numerous disadvantages among them being the practical inability to move the elevator horizonally from its fixed position as the work area on the structure shifts. Thus there may be a long horizonal distance from the delivery point of the elevator at the top of the scaffold to where construction materials are required. On the other hand applicant's hoist apparatus is readily moved in increments of approximately twelve feet or less by moving it from one column to the next column of the sectional scaffold structure. Both the boom assembly and the winch assembly may be moved horizonally along the scaffold or in an alternative arrangement the boom alone may be moved horizonally by adding extra pulleys to guide the cable along a horizonal run between the winch assembly position and the boom assembly position.

The hoist according to the present invention is intended primarily for smaller jobs which would not normally have a crane on site and should not justify the cost of crane rental and a full-time operator. Such jobs have previously lifted material by man power and the use of a simple well wheel and rope. Obviously the hoist according to the present invention by replacing man power with electric power and conserving the time and effort of material handling labor will greatly contribute to the efficiency of such a small to medium-size operation. Even the large operations extending up to a height of 100 feet or about 10 to 12 floors the apparatus according to the present invention would be quite useful. The apparatus specifically disclosed is intended primarily to handle man-size loads of approximately 100 pounds and with a one-horsepower motor will do so quite quickly, typically raising such a load to the third section of scaffold in less than ten seconds. A speed change arrangement consisting of a second pair of pulleys permits much heavier loads of several hundred pounds to be lifted at a correspondingly slower rate so that large pieces of masonry, steel, or the like could be handled if necessary. The hoist apparatus is controlled from a remote controller which reverses or deactivates the motor; the controller can be either at the top or the bottom of the scaffold. A limit switch disables the motor in the forward (upward lifting) direction before the lift hook reaches the boom at the top of the hoist, and a second limit switch may be employed to stop the down travel when the hook reaches the ground. It may be noted that the non-reciprocal characteristic of a worm drive for the winch drum makes it unnecessary to provide a brake or clutch for the hoist. The hoist is simply driven up or down by the reversible motor and the cable drum is effectively locked in position at all times at the position to which it is driven by the electric motor.

Numerous hoisting and lifting arrangements have been provided for the building trades, some of which were intended to be associated with a scaffold structure. It is not uncommon for such winches to have worm gear drives. Furthermore hoists with automatic cut-offs as the load hook approaches the top of its travel are also known as shown for example in Nelles U.S. Pat. No. 2,428,578 and King U.S. Pat. No. 2,681,954.

In general these hoist structures have been found to be separate units from the scaffolding structure to which they delivered materials, and thus, differed from the structure of the hoist apparatus according to the invention. Adjustable scaffold and derrick structures intended for smoke-stack construction and the like are known, as is shown in U.S. Pat. No. 923,002 to Bailer. This is an arrangement wherein the scaffold and the derrick is supported by the structure which is being built and is periodically lifted, by its bootstraps so to speak, as the height of the construction increases. Thus the patent to Bailer has no applicability to a hoist for use with a modular or sectional free-standing scaffold structure. A hand-powered hoist structure to be added to the top of a scaffold is found in the patent to Wardell which is primarily concerned with a cage in which the load is placed to be lifted. Wardell provides no motor or control mechanism and apparently intends that his apparatus be man-powered by a man standing at the top of the scaffold.

The scaffold hoist of the present invention is clearly superior to prior arrangements such as that of Wardell which is "built in" to the scaffold, but is only a man-powered device for which there does not appear to by any effective way to add a motor except possibly at the top of the scaffold hoist.

Thus, the scaffold mounted hoist of the present invention provides great advantages for lifting materials to the top of a sectional scaffold structure as compared with customary practices and apparatus shown in prior patents; since the present motor-powered hoist apparatus utilizes the existing scaffold structure as a mast for the hoist the added structure for the hoist apparatus is kept to a minimum. This not only reduces the apparatus cost but renders it quite simple and expeditious to move the hoist from one position to another on the scaffold or from one scaffold to another. The scaffold mounted hoist is simple and safe to operate and can be readily used without the necessity for a full time operator. At the same time it is capable of delivering large quantities of material in a relatively short time.

In addition to providing the features and advantages described above it is an object of the present invention to provide a hoist for use with a sectional scaffold having a boom assembly which is secured to an upper portion of the scaffold so that the scaffold structure serves as a mast for the hoist.

It is another object of the present invention to provide such a hoist where the boom is mounted in a bearing to be rotatable by hand and a pulley on the boom provides a vertical cable-run which is substantially colinear with the axis of rotation of the boom.

It is a further object of the present invention to provide such a scaffold mounted hoist wherein the winch secured at the lower portion of the scaffold is driven by a reversible electric motor through a worm drive to give self-braking operation in raising or lowering a load and further having a limit switch to stop the motor at the end of load travel.

It is a still further object of the present invention to provide such a scaffold mounted hoist wherein the boom assembly and the winch assembly may be readily dismounted and moved, and wherein pulleys may be mounted on the scaffold to provide a horizontal cable-run permitting the boom to be located other than directly above the winch assembly.

Other objects and advantages of the invention will be apparent from consideration of the following description in conjunction with the appended drawings in which.

Figure 1:
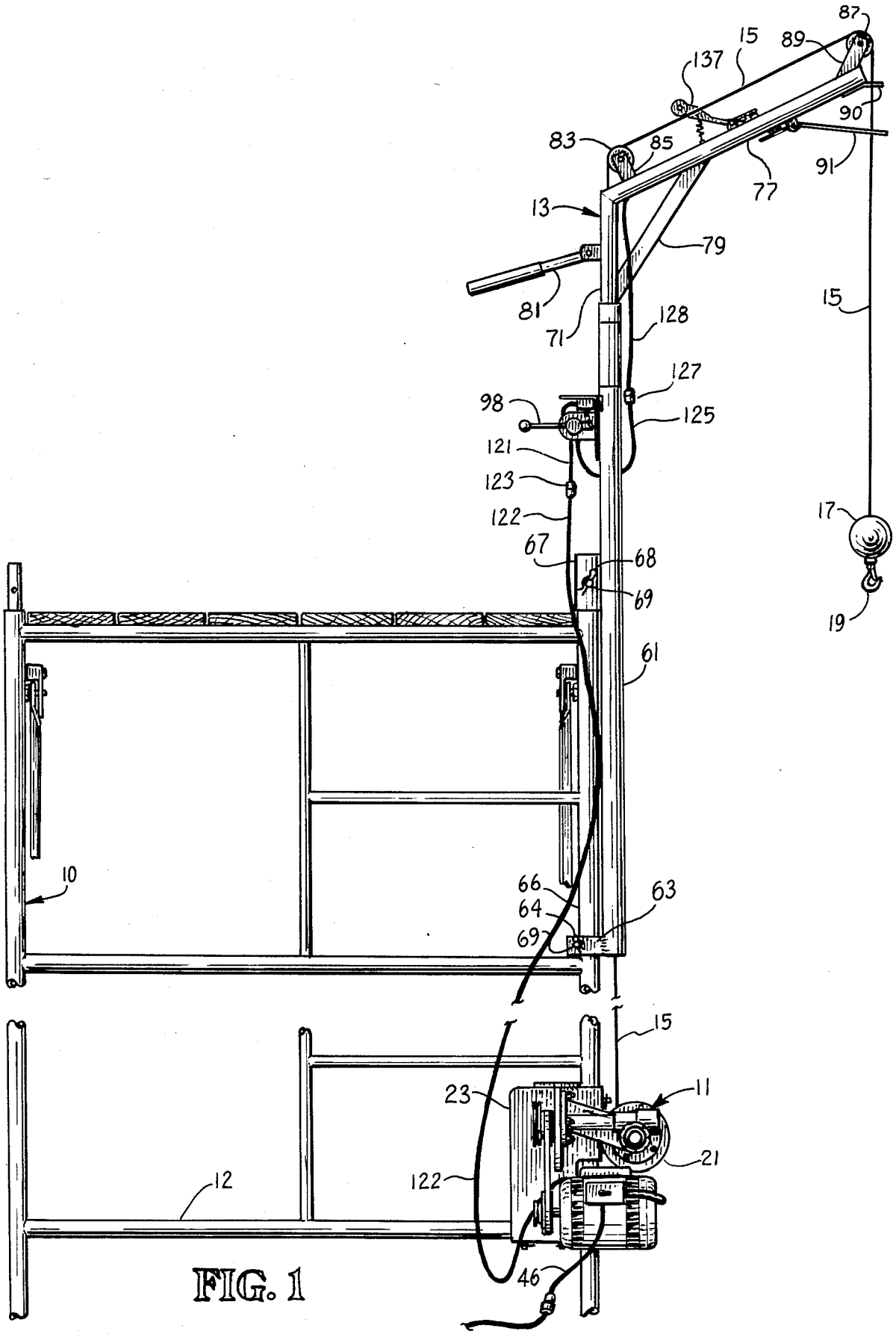
FIG. 1 is a front-elevational view of the scaffold mounted hoist according to the invention secured to a sectional scaffold.
Figure 2:
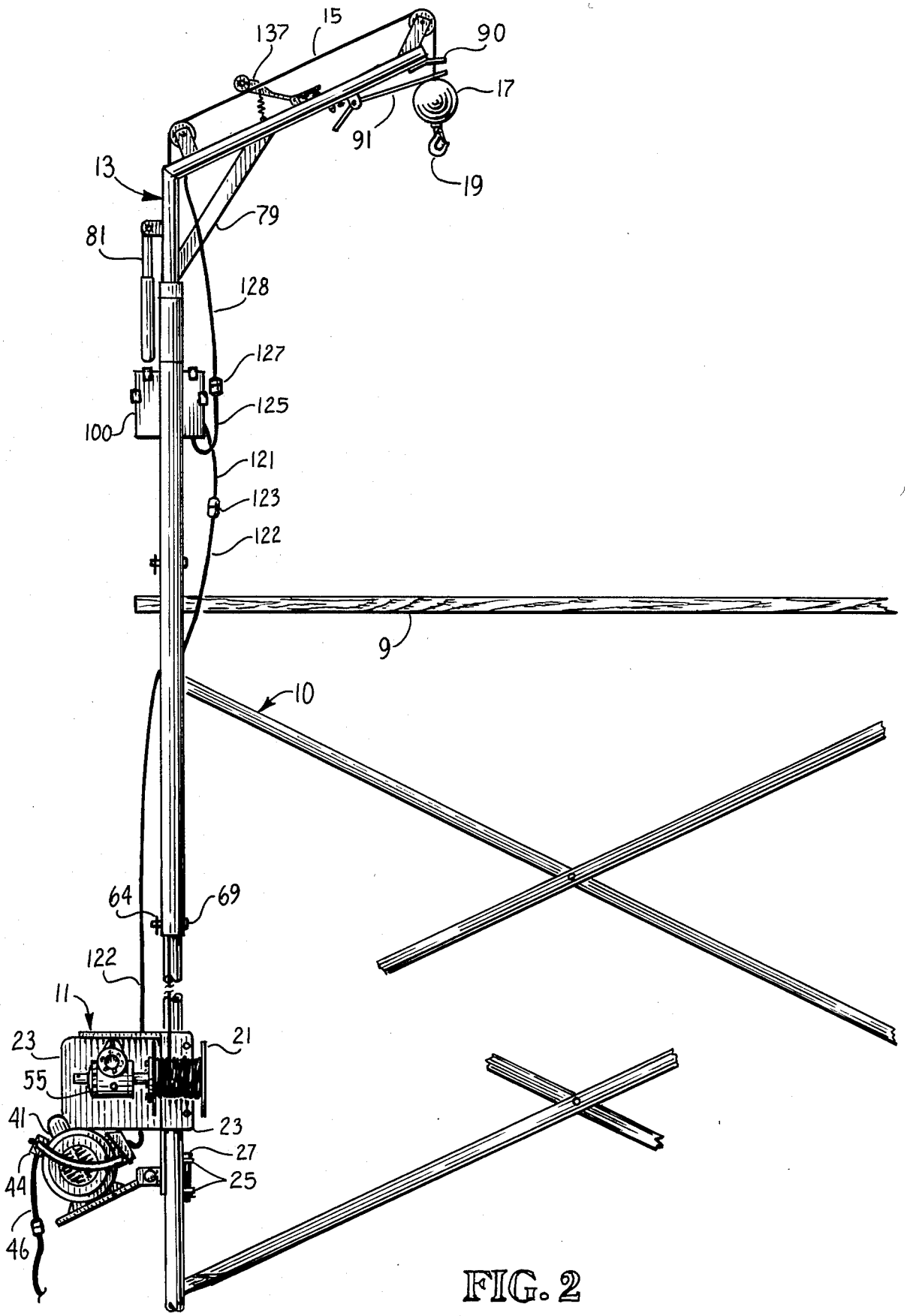
FIG. 2 is a side-elevational view of the apparatus of FIG. 1.

Referring now to the drawings and particularly FIGS. 1 and 2 a sectional scaffold 10 is shown of the sort commonly used in buiiding construction. The middle portion is broken away and only the upper and lower portions of the scaffold are shown; it may be up to 100 feet in height.

A winch assembly 11 is secured on the lower portion of the scaffold preferably at the lowest scaffolding cross-piece 12 which will normally be about two feet above ground level.

Secured to the top-most section of scaffolding is a boom assembly 13 and a cable 15 runs from winch assembly 11 upwardly to boom assembly 13 and down to a weight 17 to which is secured a load hook 19. Cable 15 is secured to and wound on winch drum 21 which is rotatably mounted on mounting bracket 23.

Figure 4:
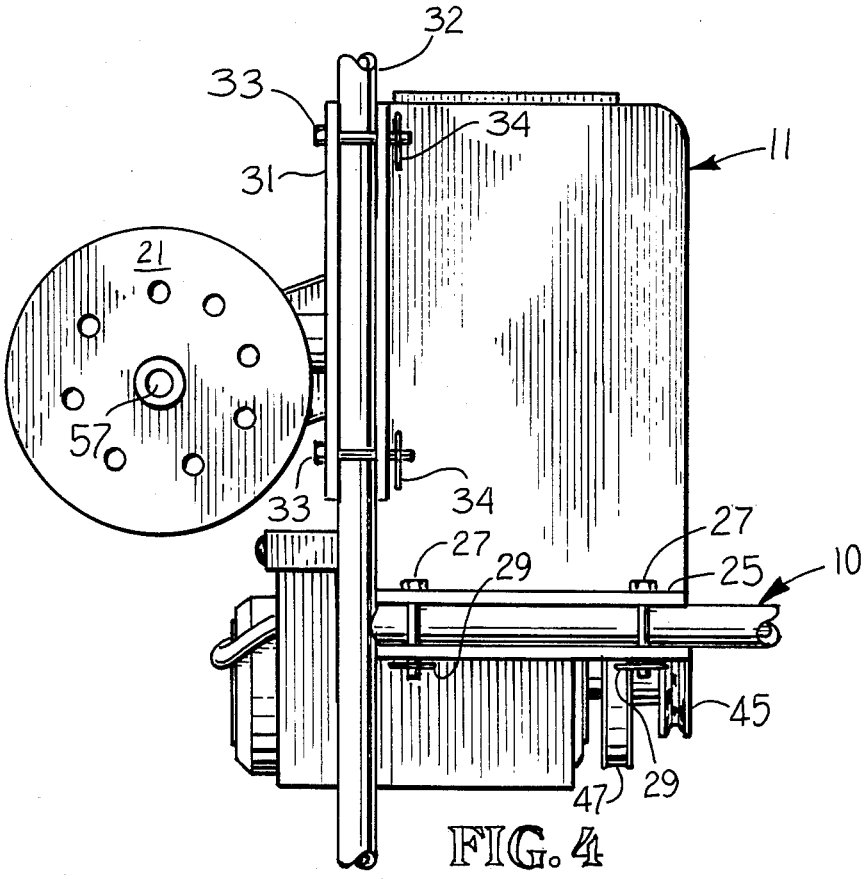
FIG. 4 is an enlarged side-elevational view of the winch assembly and motor of FIGS. 1–3.

Mounting bracket 23 is secured on the scaffold (as shown in FIG. 4) by means of a channel member 25 which fits over cross-piece 12 and is held in place by steel pin 27 passing through holes in channel 25 and locked with a cotter pin 29. Also secured to mounting bracket 23 is a vertical channel 31 which engages column 32 of the scaffold 10 and is retained in position by steel pins 33; steel pins 33 are removably secured by cotter pins 34 as best shown in FIG. 4.

Figure 3:
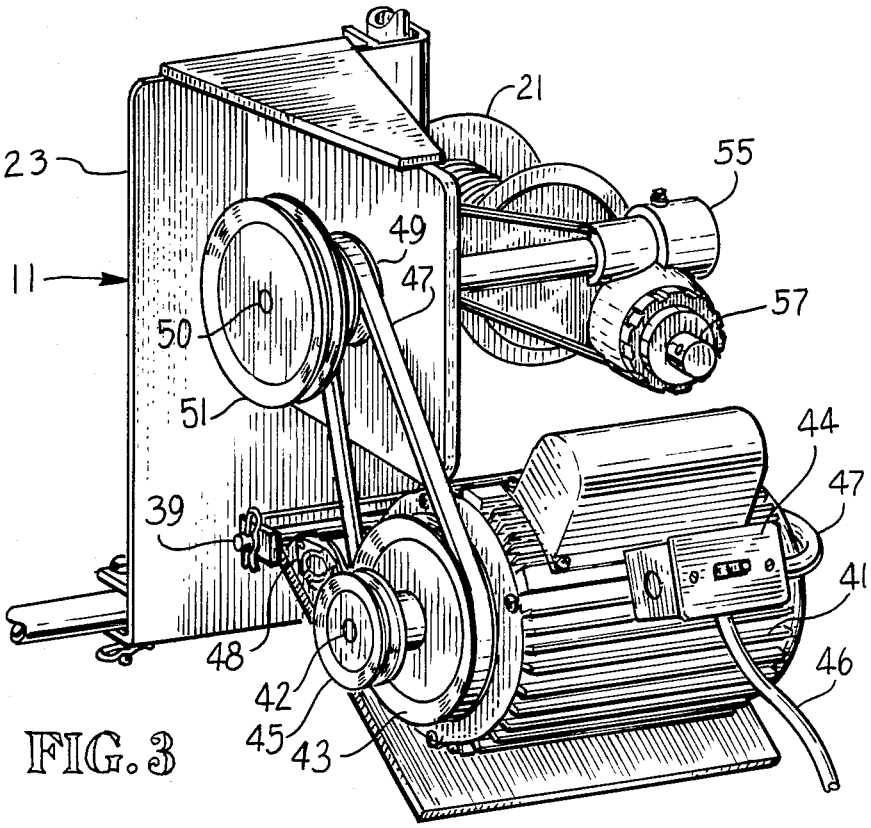
FIG. 3 is an enlarged detail perspective view of the winch assembly and motor shown in FIGS. 1. and 2.

A reversible motor 41 of ½ to 2 horsepower is secured to a base plate 34 which is pivotably attached to bracket 23 by a hinge 39 as seen in FIG. 3. Motor 41 has a shaft 42 to which are secured a large pulley 43 and a small pulley 45. As shown in FIG. 3 large pulley 43 is provided with a belt 47 which drives a small pulley 49 affixed on the shaft 50 of a worm drive 55; also affixed to shaft 50 is a large pulley 51 which may be arranged to be belt driven by small pulley 45 on motor shaft 42 to drive the hoist cable at a lower speed with greater lifting ability. Worm drive 55 is a conventional worm drive as utilized in gas-powered tillers and other mechanical equipment and may have a reduction ratio of approximately 30 to 1 between shaft 50 and shaft 57 which drives winch drum 21.

A main power switch 44 for the hoist apparatus may conveniently be mounted on motor 41. Electric cable 46 together with whatever extension cable may be required will connect the apparatus to a 120 volt power supply. It will be understood that the apparatus is described as operating on 120 volt a.c. power as this is the most conveniently available, but it may equally well be adapted to operate on other electric power such as 12 volt d.c. or from any other power source, electrical or non-electrical.

As previously mentioned motor 41 is a reversible motor, and in the present example this is accomplished by reversing an electrical connection to certain of the motor windings. To provide for remote reversing of the motor four conductors from the motor are brought out in a cable 47 to connector 48 shown in FIG. 3. The connector 48 is an all-westher connector which may be of the sort used with motor homes and recreational vehicles.

Figure 5:
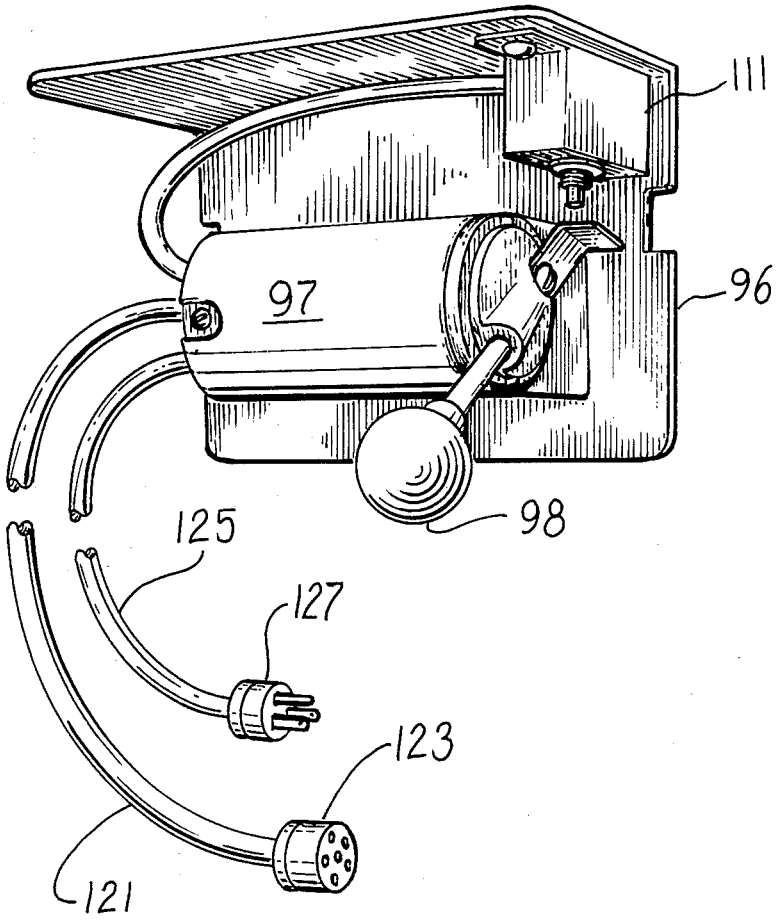
FIG. 5 is an enlarged perspective view of the motor-controller unit shown in FIG. 1.

Referring to FIG. 5, a control and reversing switch 97 is shown mounted on a bracket 96 having hooks 99 (visable in FIG. 6.) which allow the switch 97 to be conveniently placed and supported on a plate 100 forming a part of boom assembly 13.

A cable 121 (and optional extension cable 122) is provided for connecting the control and reversing switch 97 to motor 41 through connector 123 and connector 48. Cable 125 and connector 127 serve to connect limit switches (later to be described) to the switch 97. In the specific embodiment illustrated an override switch 111 is arranged to be operated when switch control lever 98 is moved to the downward position. Alternatively the override switch function may be provided by contacts within control and reversing switch 97. The operation of the various switches including switch 97, switch 111 and the limit switches will be explained with reference to the schematic diagram of FIG. 9.

Figure 6:
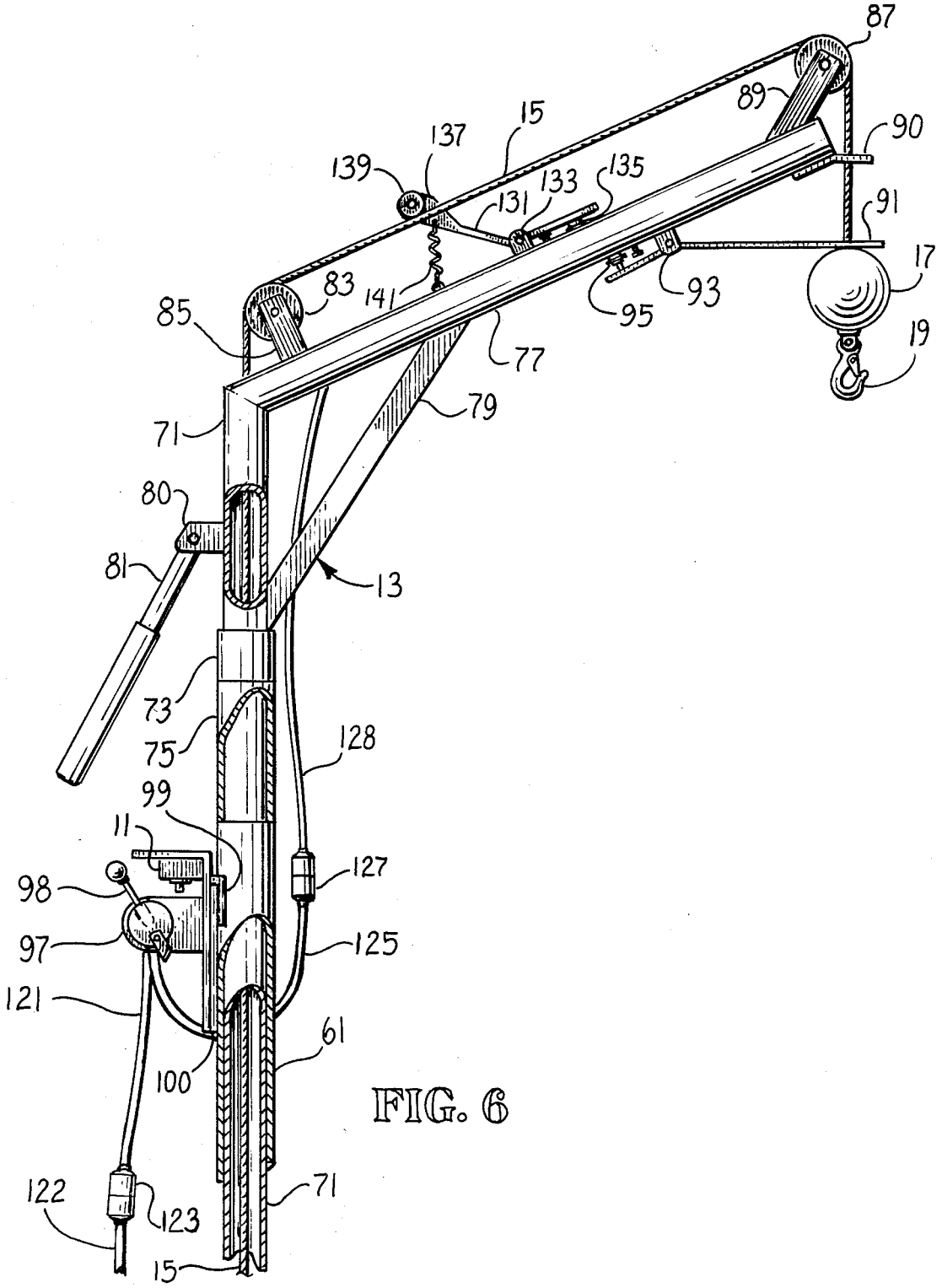
FIG. 6 is an enlarged front-elevational view of the upper portion of the apparatus of FIG. 1.

As shown in FIGS. 1, 2, and 6 the boom assembly 13 includes a mast section 61 having a short tube section 67 welded or otherwise secured thereto and which fits over the top scaffold section column 65 as seen in FIG. 1. A steel pin 69 and cotter pin 68 prevent tube section 67 from being upwardly displaced from column 65. A channel member 63 is secured at the bottom of mast section 61 where it engages column 66 and is locked thereto by steel pin 65 and cotter pin 64.

A shaft 71 slides into mast section 61, there being sufficient clearance between shaft 71 and the internal dimension of mast section 61 to permit free rotation of shaft 71 from which extends boom member 77. Shaft 71 has a collar 73 secured thereon by welding or other suitable means. In the arrangement shown in FIG. 6 a spacer tube 75 has been placed between the top of mast section 61 and the collar 73 to slightly raise the height of the shaft 71 and the boom element 77. Alternatively a longer tubing section could raise the height of boom element 77 by an even greater amount, up to three or four feet, or the spacer tube 75 could be removed to allow the collar 73 to rest directly on the top of mast section 61 to provide a minimum elevation for the boom element 77 above decking 9 of scaffold 10.

Figure 7:
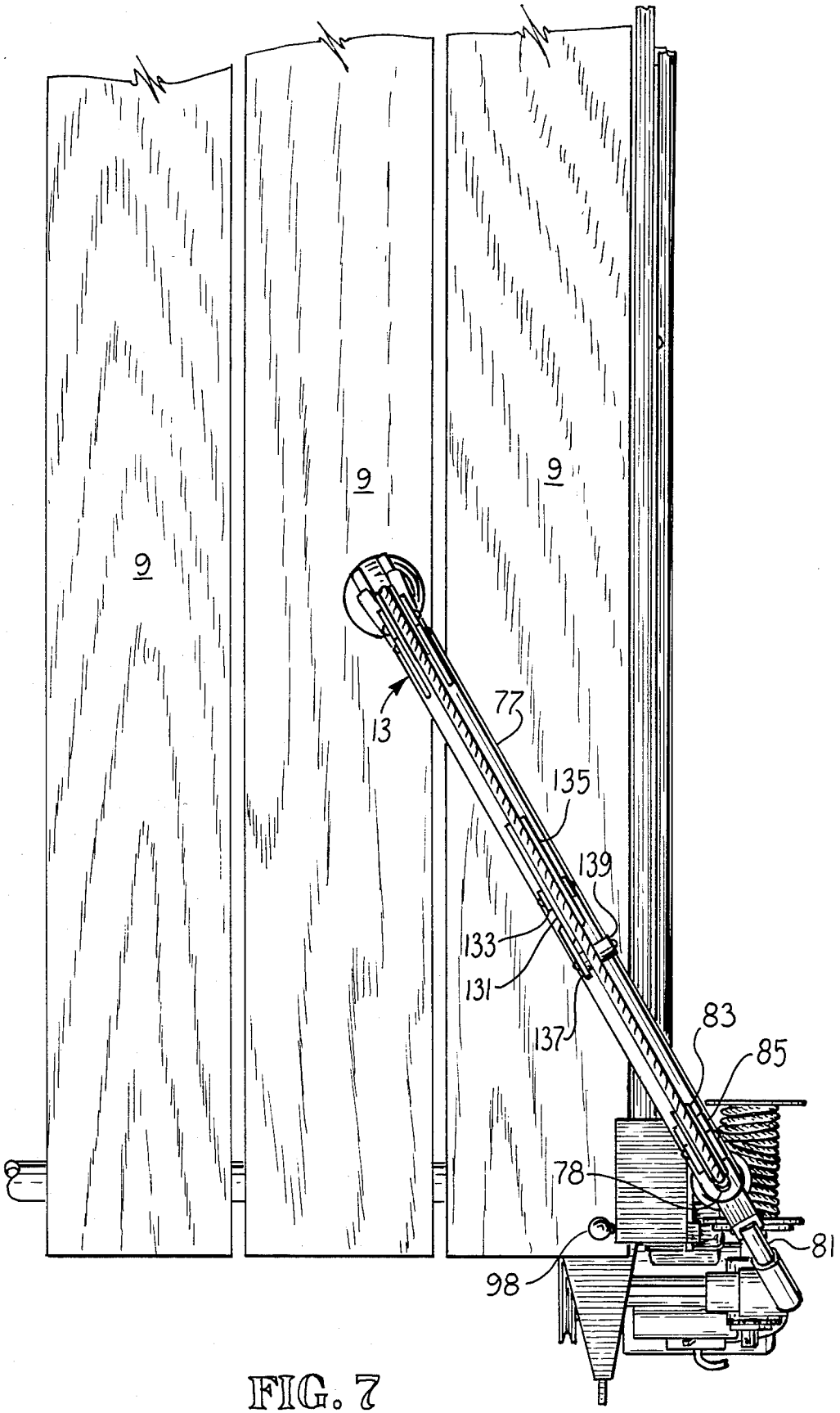
FIG. 7 is a top plan view of the apparatus of FIG. 1. with the boom turned to place a load over the scaffold platform.

A handle 81 is secured to rotate shaft 71 by hand and with it the boom element 77. Handle 81 is preferably provided with a hinge 80 so that when not in use it is permitted to drop to a substantially vertical position where it does not present a hazardous obstruction. Cable 15 runs into the bottom of mast section 61 through the central opening therein and also through the central opening in shaft 71 from which it emerges at an upper opening 78 provided in boom element 77 as seen in FIG. 7. Cable 15 is guided by an inner pulley 83 rotatably mounted in pulley bracket 85 near the inner end of boom element 77 to an outer pulley 87 rotatably mounted in a pulley bracket 89 secured near the outer end of boom element 77.

A fork guide 90 also stabilizes cable 15 and serves to prevent it from being dislodged from pulley 87. In general in the apparatus shown and described here optional guards over pulleys, over cable runs and other moving parts have been omitted for clarity in showing operational parts as they do not form part of the invention. It will be understood that conventional guards and shields will be provided as necessary over pulleys and over cable runs, winch drums, belt drives, and the like to minimize the possibility of injury through careless operator actions.

Figure 9:
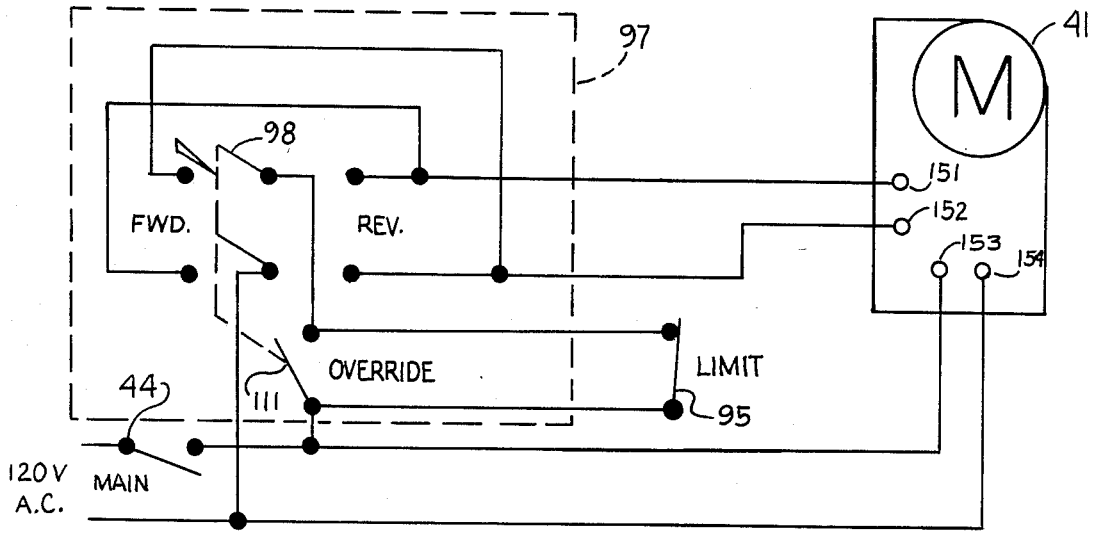
FIG. 9 is an electrical circuit diagram for the motor and control units of FIGS. 1–7.

A limit switch 95 is provided having an operating arm 91 pivotably mounted by hinge element 93 with result that the weight of arm 91 keeps limit switch 95 operated to the closed position in normal operation and when weight 17 nears the top of its travel arm 91 is lifted thereby causing switch 95 to open and causing motor 41 to stop as will be more fully described in the explanation of the circuit diagram of FIG. 9. Brace 79 is provided to strengthen and rigidify the boom assembly and permit boom element 77 to support loads of several hundred pounds or more. The weight of the scaffold normally provides more than adequate counter-weight for the load which has a lever arm of only three to four feet at most. Of course, additional counter-weight could be added if desired.

An optional second limit switch 135 for downtravel of the hoist is shown best in FIGS. 6 and 7. An operating arm 131 for switch 135 is secured by hinge 133 on the top of boom 77. A roller 139 is rotatably mounted on the up-turned end 137 of arm 131; tension in cable 15 causes roller 139 to be lifted against the tension of spring 141 connected between arm 131 and boom 77; as a result switch 135 is closed when there is tension in cable 15 between pulleys 83 and 87. Weight 17 will preferably be at least ten pounds and will be just sufficient to extend spring 141 causing switch 135 to close. When weight 117 is lowered to rest on the ground or other support the weight of the cable 15 hanging from pulley 87 will be insufficient to extend spring 141 and arm 131 will move to open switch 135.

Figures 8A, 8B, 8C:
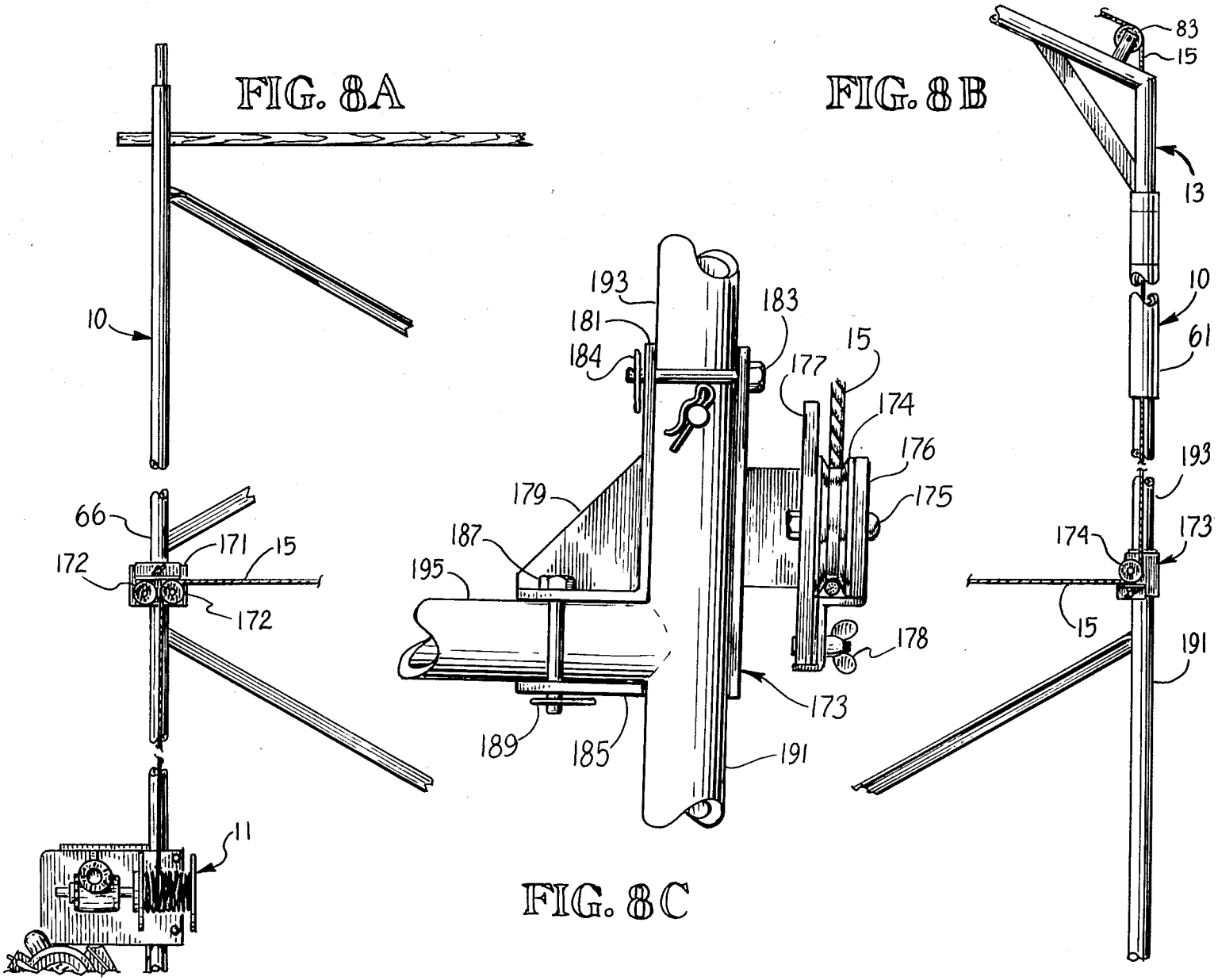
FIGS. 8A and 8B are front-elevational views of an alternative arrangement of pulleys providing a horizonal cable-run where the boom assembly is located other than directly above the winch assembly.
FIG. 8C is an enlarged side-elevational view of a portion of the apparatus of FIG. 8B.

Referring now to FIGS. 8A, 8B, and 8C an optional attachment to the apparatus is shown whereby the lateral position of the boom assembly can be displaced from the position of the winch assembly 11.

As shown in FIGS. 8A and 8B a first pulley bracket 171 is secured to column 66 of scaffold 10 above winch assembly 11; two pulleys 172 are rotatably mounted on bracket 171; only one of the pulleys is used at a time depending on whether a right displacement or a left displacement of the boom assembly 13 is being implemented. Cable 15 runs upwardly from winch assembly 11 over the right pulley 172 and extends to the right in FIG. 8A. FIG. 8B shows the continuation of cable 15 around pulley 174 rotatably mounted on second pulley bracket 173. Pulley bracket 173 is mounted at the junction of a lowermost scaffold column section 191 and the next higher scaffold column section 193. Cable 15 runs upwardly from pulley 174 through mast 61 and over pulley 83 as shown in FIG. 6. and described above.

The detail of bracket 173 is shown in FIG. 8C and the mounting arrangement for bracket 171 is similar thereto. Bracket 173 includes a mounting plate 177 for pulley 174 which is rotatably mounted thereon by a bolt 175 or other appropriate means. A guard 176 over pulley 175 is secured in position by a thumb screw 178. The guard 176 serves to prevent injury to operating personnel and also prevents cable 15 from slipping off pulley 174. Mounting plate 177 is secured to brace 179; brace 179 is in turn secured to a vertical channel element 181 and a horizontal channel element 185 which engage respectively vertical column section 193 and a horizontal tubing element 195 of scaffold 10.

Forces on pulley 174 are transferred to the scaffold by the channel elements 181 and 185 together with pins 183 and 187 securing the bracket 173 to the scaffold. Pins 183 and 187 are locked in position by cotter pins 184 and 189. Bracket 173 may be mounted in an inverted position relative to that shown in FIG. 8C if desired to better accomodate a left displacement of boom assembly 13 from winch assembly 11. Guard 176 may be placed above the pulley rather than as shown in FIG. 8C by removing thumb screw 178 and relocating it to a hole (not shown) in the top of mounting plate 177. A bracket like bracket 173 may be used in place of bracket 171.

Figure 10:
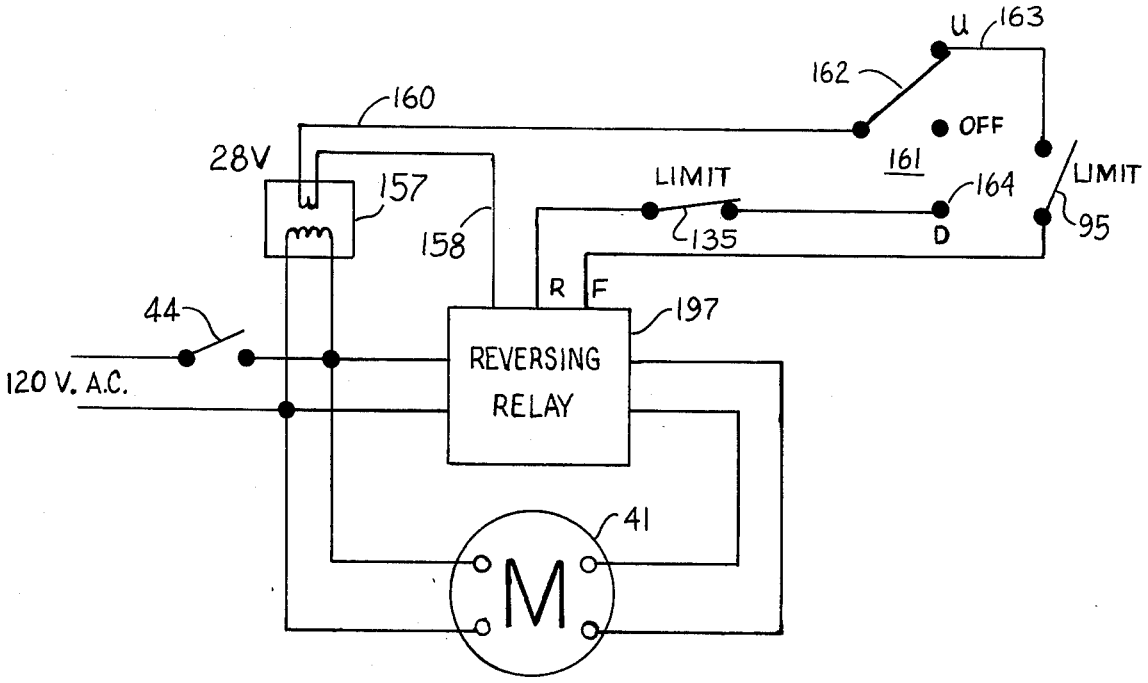
FIG. 10 is an electrical circuit diagram of an alternative low voltage relay control circuit usable in place of the circuit of FIG. 9.

The operation of the electrical control and limit switches may be understood by reference to FIGS. 9 and 10. In FIG. 9. a simple arrangement using readily available parts is shown. Switch 97 is a conventional double-pole, double-throw, center-off switch having an operating lever 98 to which has been added an override switch 111 in the form of a single-pole, single-throw switch coupled to operate with lever 98.

Limit switch 95 is in parallel with override switch 111. FIG. 9. does not show a provision for the optional limit switch 135, but it might be added to FIG. 9. to function in accordance with the following description. Motor 41 in FIG. 9. is reversible by reversing the connection of power leads to terminals 151 and 152 while the power leads to terminals 153 and 154 remain unchanged. In other forms of reversible electric motors the control switch 97 would provide whatever switching of conductors is necessary to reverse and deactivate the motor.

In operation of the circuit of FIG. 9, when switch 97 has its control lever 98 move to the reverse position, override switch 111 is also closed and motor 41 will operate in reverse regardless of the position of limit switch 95. When lever 98 is in the forward position however override switch 111 is open, and if limit switch 95 also opens, motor 41 is deenergized and will stop; this occurs at the top of the travel of hook 19 when weight 17 operates arm 91 to open switch 95. An override switch and limit switch 135 could similarly be added in the other input lead to switch 97 to incorporate optional limit switch 135 in the circuit.

FIG. 10 shows an alternative circuit for controlling motor 41 in which reversing relay 197 replaces control switch 97. Reversing relay 197 is a double-pole double-throw center-off relay arrangement of conventional form; it has an input labeled F from limit switch 95 and an input labeled R from limit switch 135.

A transformer 157 provides low voltage power, of 28 volts for example, to operate relay 197. One secondary lead 158 of transformer 157 goes to the common unmarked input to reversing relay 197 while the other secondary output lead 160 from transformer 157 goes to the contact arm 162 of a pilot switch 161. Contacts 163 and 164 of pilot switch 161 are connected respectively to limit switches 95 and 135.

The function of the circuit of FIG. 10 is similar to that of FIG. 9. As an operator moves the arm 162 to one of the up, down, or off positions the motor is caused to operate in the forward direction, the reverse direction, or to be turned off, assuming that limit switches 95 and 135 are both closed. When a load reaches the upper limit of travel, switch 95 is opened disabling forward movement of the motor; similarly when hook 17 is lowered to rest on the ground or other support limit switch 135 opens to disable reverse operation of the motor. Other variations may be employed in the electrical circuit for the apparatus in addition to those illustrated in FIGS. 9 and 10. By way of example a latching relay could be used for reversing relay 187; momentary switches then would provide up and down operation and an off switch would be connected to unlatch the relay as would the limit switches 95 and 135.

From the foregoing description and explanation it will be seen that the present invention provides a simple, lightweight, and inexpensive scaffold mountable hoist for small and medium sized constructions jobs which very effectively solves the problem of lifting materials to the top level of a sectional steel scaffold. The scaffold mounted hoist is very efficient in terms of saving time and labor and is inherently safe in operation. Either the upper boom assembly or the entire scaffold mounted hoist arrangement can be moved from one location of the scaffold to another in just a few minutes; this can be especially useful when using the hoist to add new sections to the scaffold. In many cases the scaffold mounted hoist can eliminate the need for a crane and a crane operator with a great saving in construction expense.

In addition to the various modifications to the invention which have been illustrated or suggested above numerous other modifications and variations will be apparent to those skilled in the art, and accordingly the scope of the invention is not to be considered limited to the particular embodiment shown and suggested but is rather to be determined by reference to the appended claims.

What is claimed is:

1. A scaffold mountable hoist comprising a winch assembly including a scaffold mounting bracket for temporarily mounting said assembly to a lower portion of an assembled scaffold structure, a reversible electric motor mounted to said bracket, a cable drum rotably secured to said bracket, a worm drive mechanism attached to drive said drum from said motor, and a cable secured to said drum, a boom assembly separate from said winch assembly including a mast element having at its lower end a member shaped to engage and to lock on a structural element of said scaffold and at its upper end a tube adapted to fit over the top of a scaffold column thereby providing means for temporarily securing said mast element in upright position to an upper portion of an assembled scaffold structure, a boom having a vertical tube section and a boom element portion attached thereto at an angle rotatably secured at the top of said mast element for rotation about a vertical axis, first pulley means located near the junction of said mast and boom for guiding a portion of the length of said cable upwardly to the inner end of said boom substantially colinear with the axis of rotation of said boom, said cable passing from said drum through the space between said winch assembly and said boom and through said vertical tube section, and second pulley means for guiding a portion of the length of said cable from the inner end of said boom to near the outer end thereof, and a controller unit electrically connected to said motor for causing it to operate in forward or reverse direction under manual control.

2. Apparatus as recited in claim 1 wherein said worm drive mechanism has a worm drive shaft and a pulley secured thereon and said motor has a shaft with a drive pulley secured thereon and further including a belt running over said pulleys.

3. Apparatus as recited in claim 2 wherein said worm drive mechanism has a second pulley secured on its shaft and said motor has a second drive pulley secured on its shaft and further including means to relieve tension on and to permit shifting of said belt to said second pulley and second drive pulley to change the drive speed of said drum.

4. Apparatus as recited in claim 1 wherein said means for temporarily securing the mast element includes a channel-shaped member shaped to engage a structural member of a sectional scaffold and having holes therein accepting pins to lock said channel-shaped member on a structural element of said scaffold.

5. Apparatus as recited in claim 1 further including a hinged arm and handle affixed to said boom assembly to facilitate manual rotation of said boom.

6. Apparatus as recited in claim 1 wherein said mast element is at least partially hollow and said cable extends through said mast element.

7. Apparatus as recited in claim 1 further including a hook at the end of said cable beyond said second pulley means and a limit switch responsive to the proximity of said hook to said second pulley means for disabling forward operation of said motor.

* * * * *